US005688468A

United States Patent [19]

Lu

[11] Patent Number: 5,688,468

[45] Date of Patent: Nov. 18, 1997

[54] PROCESS FOR PRODUCING NON-WOVEN WEBS

[75] Inventor: Fumin Lu, Tamarac, Fla.

[73] Assignee: Ason Engineering, Inc., Fort Lauderdale, Fla.

[21] Appl. No.: 617,023

[22] Filed: Mar. 18, 1996

Related U.S. Application Data

[63] Continuation-in-part of Ser. No. 356,738, Dec. 15, 1994, Pat. No. 5,545,371.

[51] Int. Cl.[6] ..... D01D 5/12; D04H 3/03

[52] U.S. Cl. ..... 264/555; 264/103; 264/210.8; 264/211.14

[58] Field of Search ..... 264/103, 210.8, 264/211.14, 555

[56] References Cited

U.S. PATENT DOCUMENTS

| | | | |
|---|---|---|---|
| 3,802,817 | 4/1974 | Matsuki et al. | 425/66 |
| 4,064,605 | 12/1977 | Akiyama et al. | 28/100 |
| 5,045,271 | 9/1991 | Mente et al. | 264/555 |
| 5,292,239 | 3/1994 | Zeldin et al. | 425/66 |

FOREIGN PATENT DOCUMENTS 230541 8/1987 European Pat. Off. .

*Primary Examiner*—Leo B. Tentoni

*Attorney, Agent, or Firm*—Malin, Haley, DiMaggio & Crosby, PA

[57] ABSTRACT

A process for producing a non-woven polymeric fabric web, such as a spunbond web, having filaments of 0.1 to 5 denier with equivalent production rates. A plurality of continuous polymeric filaments is extruded from an extruder and attenuated by a drawing unit that includes a longitudinal elongated slot strategically positioned at an optimum distance very close to the spinneret. A web forming table is positioned below the drawing unit for collecting the filaments and forming the filaments into a non-woven fabric web. At startup, throughput is nominal, air pressure is below 20 psig, and the spinneret is positioned more than 100 cm away from the drawing unit. Gradually, throughput is greatly increased by simultaneously increasing air pressure while reducing the distance between the spinneret and the drawing unit. Coordinating the adjustment of the throughput with air pressure and distance reduction of the spinneret and the drawing unit produces the finest filaments at equivalent production or the same filament size at the highest production rate and lowest cost.

6 Claims, 3 Drawing Sheets

PROCESS FOR PRODUCING NON-WOVEN WEBS

This application is a continuation-in-part of U.S. patent application Ser. No. 08/356,738 filed Dec. 15, 1994, now U.S. Pat. No. 5,545,371.

BACKGROUND OF THE INVENTION

1. Field of the Invention

This invention relates generally to an apparatus, process, and the product produced therefrom for constructing a spunbond, non-woven web from thermoplastic polymers producing filaments of reduced diameter and improved uniformity at an increased production rate, and specifically, to an apparatus and process for heating and extruding thermoplastic materials through a spinneret, forming filaments of finer deniers by strategically positioning the drawing unit below the spinneret at a critical distance to produce a finer filament of a desired diameter and with an improved production rate, and the resultant spunbound product. A water spray for cooling may also be employed.

2. Description of the Prior Art

Devices for producing non-woven thermoplastic fabric webs from extruded polymers through a spinneret that form a vertically oriented curtain with downward advancing filaments and air quenching the filaments in conjunction with a suction-type drawing or attenuating air slot are well known in the art. U.S. Pat. No. 5,292,239 discloses a device that reduces significant turbulence in the air flow to uniformly and consistently apply the drawing force to the filaments, which results in a uniform and predictable draw of the filaments. U.S. Pat. No. 3,802,817 discloses a sucker apparatus positioned in a selected distance below the spinneret using jet streams having velocity in the range of turbulent flow to produce fine non-woven fleeces. U.S. Pat. No. 4,064,605 and European Patent Application No. 0230541 disclose examples of the formation of non-woven fabrics.

Conventionally, thermoplastic polymers such as polypropylene, polyethylene, polyester, nylon, and blends thereof are utilized. In the first step, the polymer is melted and extruded through a spinneret to form the vertically oriented curtain of downwardly advancing filaments. The filaments are then passed through the quench chamber where they are cooled down by chilled air, reaching a temperature at which the crystallization of the filament starts, resulting in the solidification of the filaments. A drawing unit located in a fixed position below the quench chamber acts as a suction having an air slot where compressed air is introduced into the slot, drawing air into the upper open end of the slot, forms a rapidly moving downstream of air in the slot. This air stream creates a drawing force on the filaments, causing them to be attenuated or stretched and exit the bottom of the slot where they are deposited on a moving conveyor belt to form a continuous web of the filaments. The filaments of the web are then joined to each other through conventional techniques.

Providing for conventional construction of the filaments, typically filaments of 1.5 to 6 deniers or higher were produced. Using conventional methods, the hot filaments leaving the spinneret typically were immediately cooled to ambient temperature and solidified and then subjected to the drawing unit. According to a prior proposal, when the length of the filament traveling through the air is shorter than a specified value selected based on the throughput (gram per hole per minute) used, the extruded filaments will contact with solid constituent of the drawing unit in advance of solidification of the filaments, resulting in development of filament breakage or damage. In other words, even though the prior art produces suitable non-woven webs, their production is limited by the ability to cool down and solidify the filaments in a predetermined length at appropriate throughput. The filament spinning speed reached in the prior art is in the range of 3,000 to 3,500 meters per minute.

Although the conventional method and apparatus produce suitable non-woven webs, the final product could be greatly improved and better fabric can be produced consisting of lower denier filaments. A thinner filament produces more surface area and more length per unit weight. A polypropylene spunbonded fabric with filaments of 0.1 to 2.0 deniers would be desirable. When evaluating the thickness, different types of thermoplastic polymers may require some adjustment in thickness. Slightly varying diameters in other thermoplastic polymers such as polyethylene or polyester may require an adjustment also to consider the production rate.

It is also desirable that a uniformity of denier and tensile properties be consistent so that the resulting fabric web has a uniform quality.

Examples of end uses for the fabric web could be filtration materials, diaper covers and medical and personal hygiene products requiring liquid vapor barriers that are breathable and have air permeability.

With the present invention, a process for producing a superior quality non-woven web at much higher production and lower cost can be achieved. The core of the invention lies in the usage of a technique comprising principally of adjusting the processing variables such as throughput, air pressure, and volume while moving the drawing unit vertically along the spinline towards the spinneret, resulting in the reduction of air drag associated with the length of the filaments traveling with high velocity and causing an increase in drawing force exerted on the filaments of shorter length. The increased drawing force not only produces thinner filaments at higher filament spinning speed, but also creates stronger stress-induced crystallization effect, causing the on-line crystallization of filaments to occur earlier along the spinline at higher temperature and rate. Correspondingly, the filaments are solidified earlier at higher temperature, thereby resulting in less quench capacity needed or higher mass throughput can be used with the same quench capacity. 90 to 95 percent reduction of the air drag associated with the length of filaments between the drawing unit and the spinneret can be achieved by moving the drawing unit from a conventional distance of 3 to 5 meters from the spinneret to 0.2 to 0.5 meters, giving rise to the possibility of producing finer filaments at higher production rate. By changing the position of the drawing unit and utilizing a water mist, the diameter of the filaments can be controlled in such a way that while sticking among filaments in contact can be avoided, the temperature of the filaments remains as high as possible before they enter the drawing unit, reducing the viscosity of the filaments being drawn and consequently facilitating the attenuation of the filaments, resulting in filaments having much smaller diameters. The position of the web forming table corresponding to the drawing unit can also be adjusted in order to form a non-woven web which has desired uniformity with other mechanical properties.

A water mist may be added for interacting in the process to improve the filament uniformity and production. The water mist improves the process, but the basic apparatus and process will work without the water mist solely by the reduced separation of the spinneret and the drawing unit.

In terms of filament spinning speed, 4500 meters per minute for polyethylene terephthalate (PET) and 3500 meters per minute for polypropylene (PP) are achievable in the prior art and in commercial production today. With the Applicant's invention, Applicant believes that 8000 meters per minute for PET and 6400 meters per minute for PP have been achieved. Applicant has been able to produce melt-blown grade filaments (5 to 10 micronometers at spunbound production rates 70 to 150 Kg/H/M width), which is far beyond the capability of conventional production technology.

In accordance with the invention, a correct startup procedure is necessary to establish (ultimately) optimum conditions with the highest filament spinning speeds at corresponding highest throughputs. For example, a process of producing a spunbound fabric of 4.5 denier of PET filament at 4.0 gram per hole per minute (ghm) which amounts to 8000 meters per minute of filament speed cannot be established if the process begins with the drawing unit positioned close to the spinneret of less than 50 cm. The correct startup of the process is to first begin with the drawing unit positioned at least 100 to 150 cm below the spinneret and with a much lower throughput, less than 1.0 ghm and using lower air pressure, between 10 to 20 psig so that threading of the filaments through the slot of the drawing unit can be readily accomplished. Once the initial startup under these conditions is established, the air pressure and the throughput are then adjusted coordinately to a desired condition, while the drawing unit is lifted closer to the spinneret. A stable process can be obtained wherein 4.5 denier PET filaments are produced at 4.0 ghm with the drawing unit positioned 25 cm below the spinneret using 75 psig of air pressure. Applicant has found that Applicant can use distances between the spinneret and the drawing unit between 5 and 150 cm and optimally between 20 to 90 cm separation between the spinneret and the drawing unit. These small distances, however, are only achieved after the startup procedure mentioned above.

There are two distinct changes occurring for the on-line diameter profile as the filament spinning speed increases. First, the rate of reduction in diameter of the melt thread in the upper region of the spinline increases. In other words, the melt thread is thinning much faster at higher spinning speed, creating more surface area to be cooled. Secondly, the position where the filament starts to solidify due to so-called the stress-induced crystallization moves up towards the spinneret. The higher the filament speed, the less the cooling is needed (shorter quench chamber), and the drawing unit can be lifted up along the spinline without causing interruption of the process because the filaments are well solidified before entering the slot of the unit where contacts among filaments are made. When the distance between the spinneret and the drawing unit is decreased, the drag force $F_d$, which is associated with the length of filaments (dZ) traveling at high speed between spinneret and drawing unit will proportionally be reduced, resulting in increasing inertial force $F_{inserr}$, which leads to even higher filament speed, further thinner filaments and higher solidifying temperature. This in turn allows the drawing unit to be lifted further up. Our results show that depending on the material to be processed and the throughput (gram per hold per minute, referred to as ghm from now on) to be used, the drawing unit can be lifted up as close as 5 to 40 cm to the spinneret at throughput of up to 4 ghm, comparing with 2 to 4 meters being used in commercial production today, that is over 90 to 95 percent of reduction in air drag force which has significant impact on the output of the process in terms of fineness of filaments that can be produced at achievable production rate. The closer the drawing unit from the spinneret, the higher the temperature at which filaments are being drawn and the lower the elongational viscosity will be, which is inversely proportional to the elongation rate. That is, with lower elongational viscosity, higher elongation rate (higher filament speed) can be achieved under the same drawing force.

SUMMARY OF THE INVENTION

A process and apparatus for producing a spunbond, non-woven web composed of filaments of reduced diameter and improved uniformity from thermoplastic materials at an increased production rate, comprising a melt spinning machine having an extruder for heating and extruding thermoplastic materials through a spinneret, forming substantially a plurality of vertically oriented polymeric filaments and a filament drawing unit having a longitudinal elongated slot substantially equal in length to the spinneret, said drawing unit being strategically positioned below the spinneret at a critical distance to receive the filaments therein. The drawing unit is movably connected to the spinneret and can be manually or by motor moved to a desired distance from the spinneret before and during the operation of the machine to produce spunbound filaments. The distance between the elongated slot of the drawing unit and the spinneret is critically determined to provide a proper finer filament of a desired diameter, resulting in a better sized filament in diameter and an improved production rate. The important distance between the elongated slot in the drawing unit and the base of the spinneret where the plastic materials are extruded is substantially around 0.2–0.9 meters. By positioning the drawing unit relatively close to the base of the spinneret after initial startup, a finer denier filament is obtained because the drawing process happens as the hot molten threads exit the spinneret, which allow them to be cooled enough not to stick together while simultaneously being hot (soft) enough to be drawn into a finer, more uniform denier filament. In conventional devices where there is a large space between the base of the spinneret and the drawing unit, typically the hot molten threads are first cooled to ambient temperature and solidified and then reach the drawing unit where it is more difficult to achieve the type of finer or thinner filaments that are obtained from the present invention. The filaments, when hot, can be stretched or attenuated to a finer diameter using the present invention. The result is a better product because it has more surface area and length per unit weight and higher strength.

The drawing unit has a V-shaped slot along the upper portion with a horizontally directed elongated open end at the top and opposing side walls that depend from the open top end, towards each other, to form a narrow gap at the end of the upper portion of the slot. An adjacent nozzle that supplies a directed stream of air introduced into the slot along the entire length of the slot so that a turbulent flow pattern is formed in the area where two directed air streams merge with each other. The slot also includes a bottom portion that is shaped to improve randomness of the spreading of filaments for uniformity of the resultant web.

A web forming table is positioned below the drawing unit to receive the sheet of filaments, forming the same into a non-woven web.

The machine is constructed such that the position and location of the drawing unit and the web forming table can each be independently adjusted vertically along the spin line, as well as horizontally perpendicular to the spin line.

The apparatus includes two air supply nozzles communicating with the drawing slot on both sides to form an angle of 15° to 30° each, each adapted to a curved air passageway for introducing a directed stream of air. A turbulent flow pattern is created when air streams exiting from both nozzles come together in contact with the filaments as well as each other so that an intensive "flapping" or "waving" motion of the filaments is established. This interaction of the air and filaments drastically increases the air drag force exerted on the filaments, resulting in increased attenuation of the filaments.

In order to operate the drawing unit positioned 0.2 to 0.9 meters from the spinneret as described before, a startup procedure has to be followed. It begins with the drawing unit positioned at least 100 cm or more away from the spinneret at an appropriate location and a reduced polymer throughput and nominal air pressure and volume are set such that the threading of the filaments through the slot of the drawing unit can be readily accomplished. Once the spinline at this condition is established, the air pressure and the throughput can be gradually increased coordinately while the drawing unit is lifted toward the spinneret. Through this startup procedure and these adjustments of distance between the spinneret and drawing unit which gets smaller, a stable process can be obtained where the finest filaments can be produced at an equivalent or higher throughput. Therefore, once initial spinline threading is completed and the spin line stabilized, the drawing unit can then be raised manually or by motor gradually towards the spinneret while simultaneously the polymer throughput and the air pressure are appropriately increased until a position between the spinneret and drawing unit is reached to produce the finest filament (smallest denier) and best uniform web at the increased production rate. The web forming table in relation to the air drawing unit should also be accordingly adjusted for desired web properties, such as web uniformity and loftiness.

It is an object of this invention to provide a machine that produces a spunbond, non-woven web comprised of filaments having a smaller diameter than conventionally produced filaments with a better uniformity from thermoplastic materials at a higher production rate.

It is another object of this invention to produce a spunbond, non-woven web comprised of thermoplastic filaments having an optimum small denier for creating filaments with more surface area and more length per unit weight for use as a non-woven web.

And yet still another object of this invention is to provide a method for producing finer filaments with better uniformity from thermoplastic materials for use as spunbond, non-woven webs at a higher production rate.

In accordance with these and other objects which will become apparent hereinafter, the instant invention will now be described with particular reference to the accompanying drawings.

DESCRIPTION OF THE PREFERRED EMBODIMENT

Figure 1:
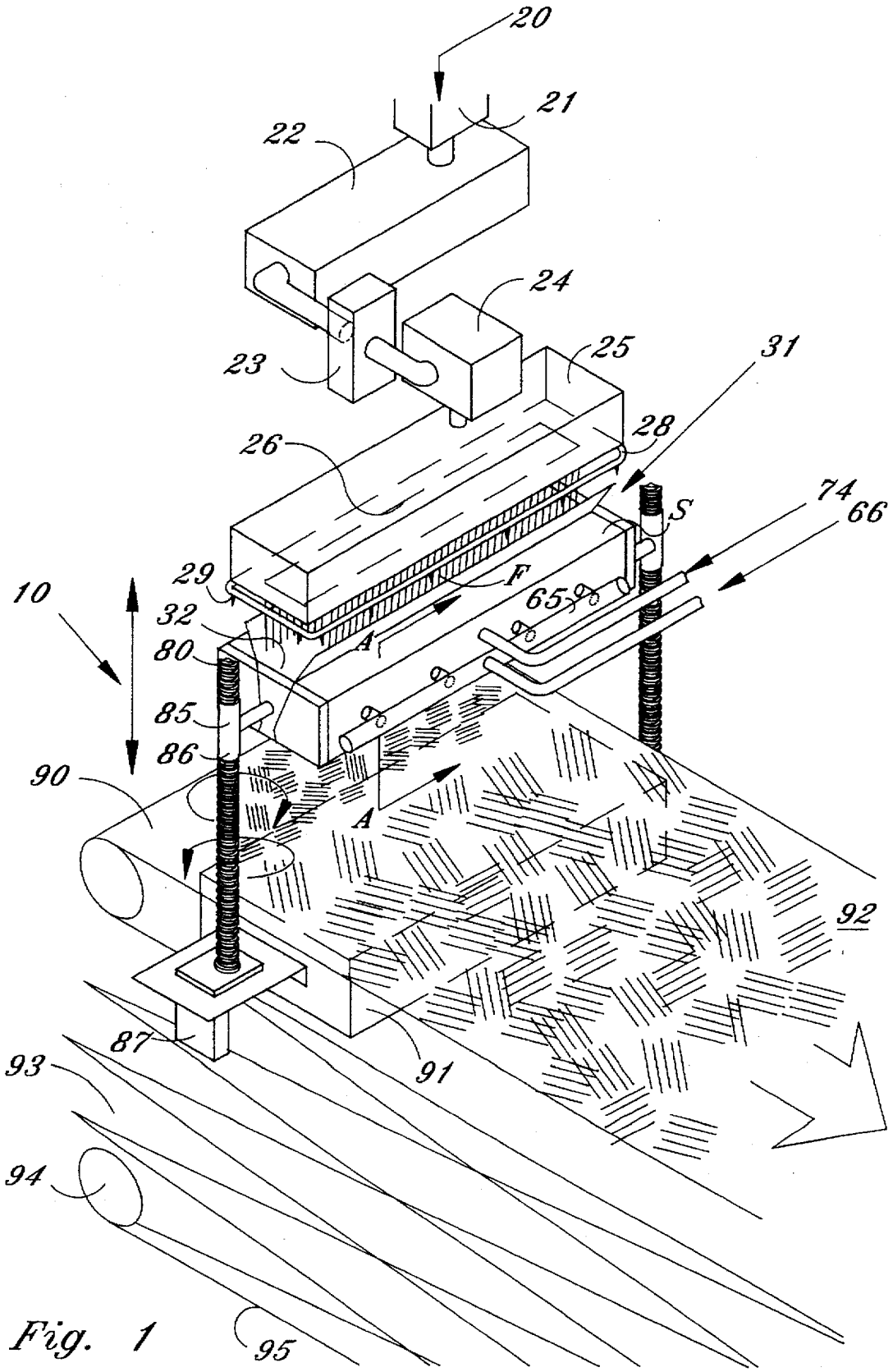
FIG. 1 shows a perspective view of the apparatus in accordance with the present invention.

Referring now to the drawings and in particular FIG. 1, the present invention is shown generally at 10 that includes an improved melt spinning machine that includes an extruder 22, spinbeam 25, and the drawing unit 31. The extruder 22 and spin beam 25 are fixedly mounted to a floor support above the movable drawing unit 31.

The drawing unit 31 is movably supported above a movable mesh wire belt conveyor 92 that is a component of the web forming table 90. The web forming table further comprises an adjustable (vertically) base 93 which can be used to adjust vertically the distance between the top of the table 90 and the spinneret 26 in a range of about 30 to 150 cm. Wheels 94 under the base 93 are mounted on a pair of tracks 95 so that the web forming table 90 can be moved back and forth horizontally to allow certain space for changing of the spinneret 26.

Polymer is fed from polymer supply 20 into hopper 21 where the polymer is heated and melted in extruder 22, pushed through filter 23 and metering pump 24 to spin beam 25, where it is then extruded through a spinneret 26 having a plurality of multi-rowed orifices, together forming a curtain of vertically downwardly advancing filaments F.

The drawing unit 31, which acts to attenuate the filaments, includes an elongated longitudinal slot 32 which is strategically aligned below the spinneret to receive the curtain of filaments which are moved by gravity and air pressure. The most important distance with respect to filament size and throughput volume after initial startup is established is the distance between the base of spinneret 26 and the top of the drawing unit 31. The filaments F, before being sucked in and drawn by the drawing unit 31, are cooled and partially solidified by a fast moving stream of mixture of air (and optionally atomized water) entrained by the suction of the drawing unit 31 of ambient air with mist produced by the water spray unit 28.

Figure 2:
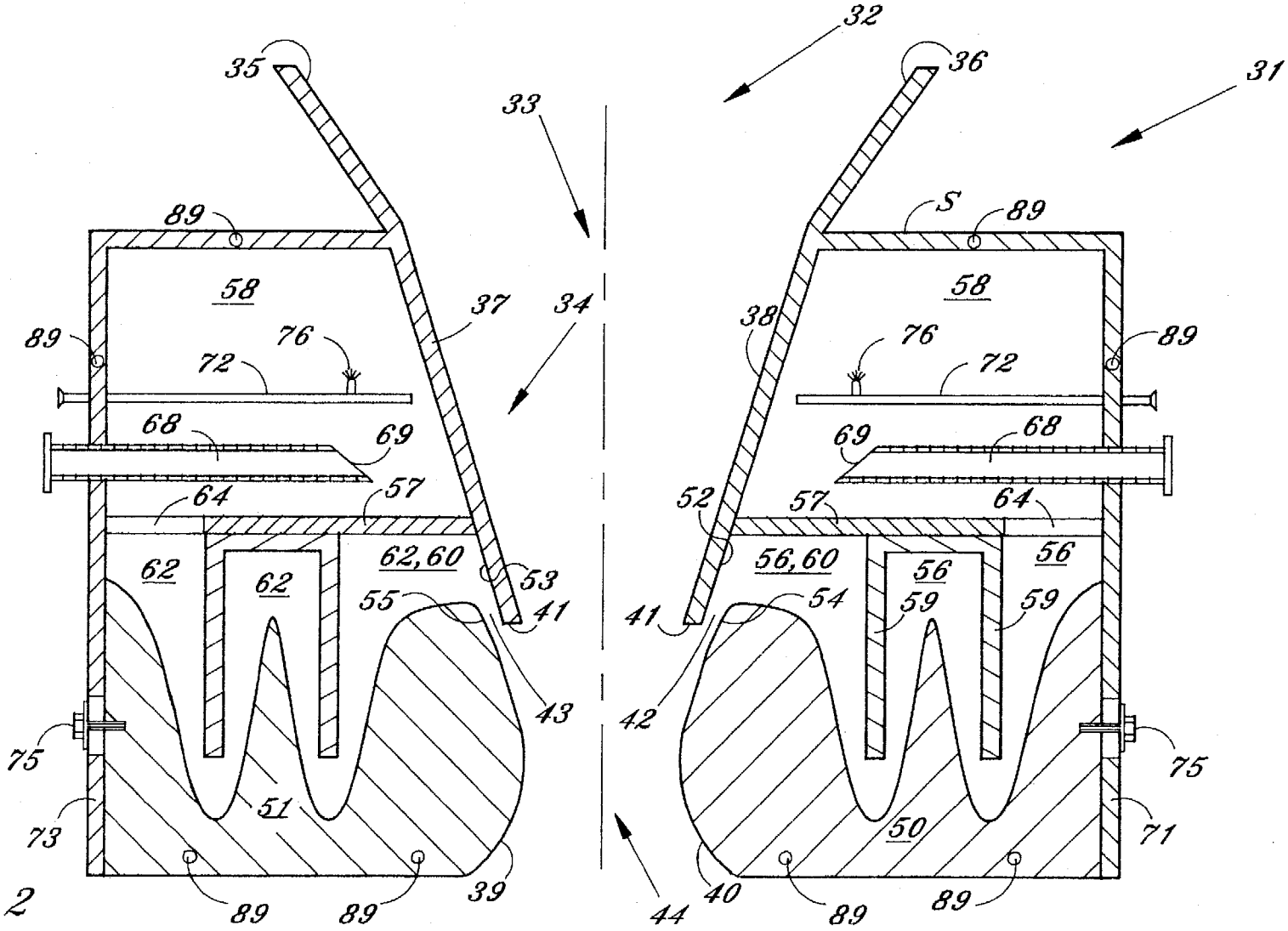
FIG. 2 shows a side elevational view of the drawing unit in cross section used in the present invention.

Referring now to FIG. 2, the drawing unit 31 includes slot 32 having a horizontally directed, elongated open top slot segment 33 that includes a pair of side walls 35 and 36 projecting from upper surface S of the drawing unit 31 at an angle of up to 90°. The drawing unit 31 also includes upper slot segment 34 comprised of a pair of side walls 37 and 38 which depend from the top slot segment 33 at an angle of substantially between 15° to 60° and preferably, 30° to 45°. The slot 32 further comprises a lower slot segment 44 having lower side walls of a pair of bottom blocks 50 and 51. Transverse shoulders 41 are positioned between the upper and lower slot segments 34 and 44 on each side of the slot 32. A pair of air nozzles 42 and 43 on each side of slot 32 extend along the entire longitudinal length of the slot 32 and are formed between inner surfaces of the lower end of the upper slot side walls 37 and 38 and the opposing surfaces 54 and 55 of bottom blocks 50 and 51.

An air passageway 56 extends along the entire longitudinal length of the slot 32 of drawing unit 31 and is defined by separation plate 57 at the bottom of air chamber 58, having two vertically sectional plates 59 attached, and a curved surface of bottom blocks 50 and 51. The air passageway 56 is divided into two segments, a discharge segment 60 connected with nozzles 42 and 43 having a gradually smoothly reducing width in the direction towards the associated nozzle and a unifying segment 62 that contains four parallel vertical sections in an arcuately curved section between each pair of vertical sections. The unifying segment of the air passageway 62 is connected with the air chamber 58 through an air window 64 which is a brake plate placed at the edge of the separation plate 57 adjacent to side walls 70 and 71 of the drawing unit 31.

Air is fed to air chamber 58 through a manifold 65 connected to a suitable air supply unit 66 (see FIG. 1). The air chamber 58 comprises a number of air lines 68 coming into air chamber 58 from manifold 65 and having an open end 69 facing up and close to side walls 37 and 38 of the upper slot segment. The arcuately curved section of the air passageway in unifying segment creates an air pressure drop which serves to equalize the air volume flow rate and velocity along the entire longitudinal length of the slot 32, especially at the outlet of the nozzles 42 and 43. The area for the passage of air decreases gradually along the air passageway from air window 64, all the way to the outlet of the nozzles 42 and 43, which also serve to unify the air pressure. As a result, the air flow at the outlet of the nozzles 42 and 43 will be uniform in volume and velocity along the entire longitudinal length of slot 32.

The air chamber 58 further includes a number of water spray heads 76 (optional) installed and in fluid communication with water inlet pipe 72 connected to a water supply unit 74. The mist from the water spray heads serves to cool down the incoming air from the air supply unit 66, which facilitates the solidification of filaments contacting the air stream.

The bottom blocks 50 and 51 of the drawing unit are constructed in such a way that the upper surfaces of the blocks, which define the air passageway with the separation plates 57 and two vertical sectional plates 59, are composed of two downwardly arcuately curved and one upwardly arcuately curved edge. The two downwardly curved edges have different depths. The edge closer to the air window 64 is 2 to 10 mm longer than the other edge. The bottom blocks 50 and 51 of the drawing unit are connected with side walls 73 and 71 of the drawing unit by a plurality of bolts 75 through extended holes on the upside walls 71 and 73 so that the positions of the blocks can be adjusted up or down to change the gap of the nozzles 42 and 43 and therefore the volume and velocity of air flow according to the needs of the process.

Figure 3:
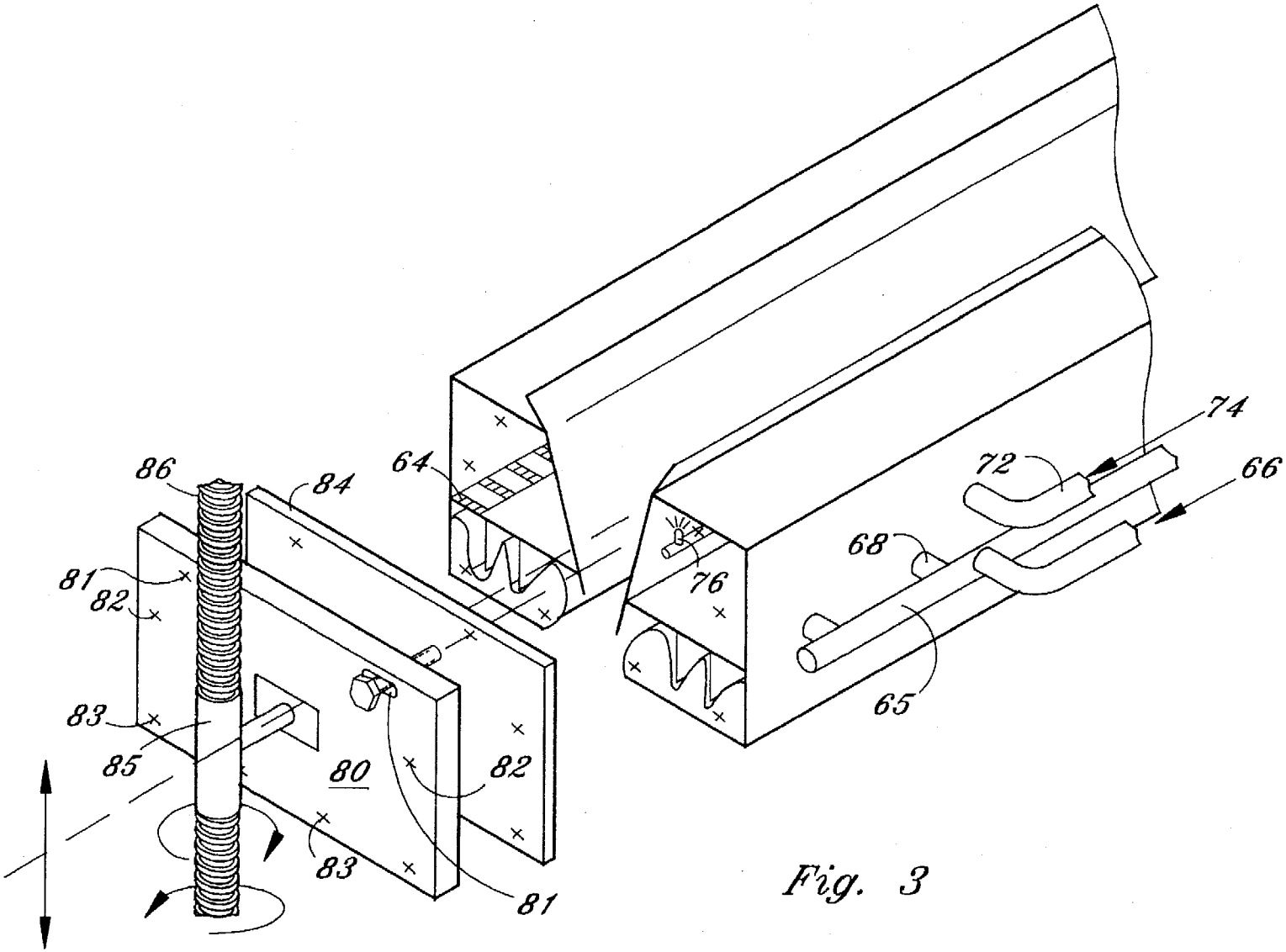
FIG. 3 shows an exploded perspective view showing a drawing unit in accordance with the present invention.

Referring now to FIG. 3, the drawing unit 31 includes on each side the side cover plate 80 connected by a number of bolts 89 through horizontally corresponding extended holes 81, 82, and 83, through which the width of the slots 34 and 44 can be adjusted. A rubber gasket 84 is used between the body of the drawing unit 31 and the side cover plate to seal the unit. The distance between the drawing unit 31 and the web forming table 90 can be adjusted with male screws 86 vertically attached to the side cover plate 80 through matching female screws 85 and driven by a motor with a gear box system 87 attached to the web forming table 90 (see FIG. 1). By turning screws 86, the position of the drawing unit 31 relative to the web forming table 90 can be correspondingly adjusted. FIG. 3 also shows the air supply 66 and water supply conduit 74 attached to input conduits 65, 68, and 72, respectively.

Referring back to FIG. 1, a very important element of the invention is shown. The web forming table 90 is positioned below the slot 32 of the drawing unit 31 to receive filaments F and form the filaments into a non-woven web. The web forming table 90 comprises a vacuum suction box for pulling down filaments onto a moving mesh wire belt conveyor 92 which transports the as-formed web to the next stage of the process for strengthening the web by conventional techniques to produce the final non-woven fabric web. The web forming table 90 includes the adjustable base 93 which is used to adjust vertically the vertical distance between the top of the table 90 and the spinneret 26 in a range of about 30 to 180 cm. The critical distance between the drawing unit 31 (along the top slot 32) and the lower portion or surface of the spinneret 26 is a critical adjustment and critical distance to accomplish the invention. The distance between the bottom of the spinneret and the top of the drawing unit can be adjusted, preferably between 10 to 90 cm during normal production. The following is an example of an apparatus constructed in accordance with the present invention using polypropylene as the polymer.

EXAMPLE 1

A correct startup procedure is necessary in order to ultimately establish optimum conditions where the highest filament spinning speed at a corresponding throughput is reached. Therefore, at initial startup, the distance from the top of the drawing unit to the spinneret is in conventional range of from 100 to 150 cm separation distance or greater. A lower throughput, less than 1.0 ghm, at a lower air pressure of 10 to 20 psig, is established so that threading of the filaments through the slot can easily be accomplished. Once the continuous filament spinline at these conditions are established, the air pressure is gradually increased, which increases the spinning speed. Simultaneously, the drawing unit is positioned closer to the spinneret, at the same time adjusting the throughput and the air pressure accordingly.

The final distance from the top of the drawing unit to the spinneret is about 5 to 150 cm, preferably 20 to 90 cm, during normal production. The width at the top of top slot segment 33 of the drawing unit is about 10 to 20 cm. The width at the top of the upper slot segment 34 is about 5 to 15 cm. The width between opposing edge of slot 32 at shoulder 41 is about 0.3 to 2.0 cm. The gap of the outlet of nozzles 42,43 is about 0.1 to 0.6 mm. The air streams introduced from air supply unit 66 on both sides of the slot have a velocity of about 100 to 350 m/sec at exit of the outlet of nozzles 42,43 and form a turbulent flow as they merge. Air and mist are sucked in from the top open end 33 by the air streams exiting from nozzles 42,43 and this sucked-in stream of air with mist cools and drags filaments along the upper slot segment 34 to nozzles 42,43 where it joins the air stream of turbulent flow. The filaments thus entrained form an intensive "flapping" or "waving" pattern when moving along with the air stream below the nozzle in compliance with the pattern of the air flow. It is this intensive "flapping" motion, coupled with the closeness of the drawing unit to the spinneret, that an ideal situation is created, wherein a significantly increased air drawing force produced by "form drag" due to the flapping motion is exerted on filaments that are still "hot" and therefore readily to be stretched, resulting in filaments having a denier of about 0.1 to 2.5 for polypropylene at a production rate of about 70 to 360 kilograms per meter of machine width, hereafter referred to as a dimension corresponding to the width of the spinneret, per hour and 0.3 to 4.5 deniers for polyethylene terephthalate at a production rate of about 100 to 540 kilograms per meter of machine width per hour.

EXAMPLE 2

The width at the top of top slot segment 33 of the drawing unit is 10 cm. The width at the top of upper slot segment 34 is 5 cm. The width between opposing edge of slot 32 at shoulder 41 is 3 mm. The gap of the outlet of nozzles 42,43 is 0.1 mm.

The width of the spinneret is 10 cm. The number of holes on the spinneret is 144 with orifice diameter of 0.35 mm. The quench chamber located right beneath the spin beam is 15 by 28 (cm×cm), supplying chilled air of 45° to 60° F. The raw material used is polypropylene 35 MFR. The processing temperature used is 230° C. The throughput used is 2.5 gram per hole per minute. The distance from the top of the drawing unit to the spinneret is 40 cm. The air supplied to the drawing unit is at 3.0 NM/min with pressure of 55 psig. The distance from the bottom of the drawing unit to the surface of the web forming table 90 is 40 cm. A uniform sheet of fine filament curtain is seen exiting from the slot of the drawing unit after being stretched by the downwardly turbulent air stream merged together by two air streams from both sides of the filament curtain. The non-woven fabric thus obtained has an excellent uniformity with filament size of 3.5 deniers. The filament spinning speed in this case is 6,400 meters per minute.

The processing has to go through the startup procedures as follows. The initial polymer throughput is 0.5 gram per hole per minute. The drawing unit is positioned 150 cm below the spinneret. The air pressure of 15 psig for the drawing unit is used. Slight quench is supplied. The threading of filaments through the drawing unit under this condition is readily completed. Thereafter, the drawing unit is moved up gradually while the air pressure and the throughput are increased correspondingly and certain amount of quench air is then supplied until the final processing condition mentioned above is reached. It should be noted that there is a range of conditions under which the startup can be accomplished. The sole purpose of the startup is to thread the filaments through the slot of the drawing unit to establish a stable spinline. Without a proper startup procedure, the final processing condition can not be achieved as described above. In other words, it is impossible to thread filaments extruded at a rate of 2.5 gram per hole per minute through a drawing unit positioned 40 cm below the spinneret without facing a problem of unsolidified filaments contacting the solid constituent of the drawing unit, causing severe blockage of the slot and the process has to be stopped.

EXAMPLE 3

Using the same equipment setting as in Example 2 with the raw material being PET (polyethylene terephthalate). The processing temperature used is 290° C. As a startup, throughput of 0.5 gram per hole per minute is used and the drawing unit is positioned 120 cm from the spinneret. No quench air is needed. The air pressure of 20 psig with volume rate of 2.0 NM/min is supplied to the drawing unit. The threading of the filaments through the slot can be readily achieved. Then, gradually increasing the air pressure and the throughput while moving up the drawing unit as described in Example 2. The processing condition of throughput of 4.0 gram per hole per minute and air pressure of 70 psig with the drawing unit positioned 25 cm from the spinneret and the forming table 40 cm below the slot is finally established. The web thus obtained has an excellent uniformity with filament size of 4.5 deniers. The filament spinning speed is 8,000 meters per minute.

EXAMPLE 4

As in Example 2 with 35 MFR polypropylene, when lower throughput is sued, the non-woven web thus obtained has better uniformity with different filament sizes. For throughput of 1.0 gram per hole per minute, air pressure for the drawing unit is 45 psig and the drawing unit is 30 cm away from the spinneret, the web with filament size of 1.8 deniers is produced. For throughput of 0.5 gram per hole per minute, air pressure of 35 psig with drawing unit 30 cm below the spinneret, the web with filament size of 1.0 denier is produced. As the throughput is reduced to 0.1 gram per hole per minute at air pressure of 25 psig and the drawing unit 20 cm below the spinneret, extremely uniform web with filament size of 0.25 deniers is obtained.

During startup, filaments are extruded through a spinneret in a form of downwardly vertically advancing curtain at nominal throughput and the drawing unit is positioned way down from the spinneret with nominal air pressure and volume. With this setting, the filament curtain can be cooled down even by ambient air alone to avoid sticking among filaments before being sucked into the drawing unit. When spinline is fully established and stabilized, the drawing unit is moved up towards the spinneret gradually while simultaneously increasing the pressure and volume of the air supply to the drawing unit and the polymer throughput. As the drawing unit moves up closer to the spinneret and higher air pressure and volume are used, the temperature at which the filaments are being drawn and the drawing force on the filaments are correspondingly increased, resulting in filaments of smaller size. Reduction in filament size facilitates the cooling of filaments so that the drawing unit can be further moved up toward the spinneret without causing filaments sticking to each other before entering the drawing unit. By repeating those steps of alternatively adjusting the position of the drawing unit, the volume and pressure of the air supply and the throughput of the polymer melt, a desired production can be reached wherein the finest (smallest denier) filaments are produced at maximum throughput for the given process condition. While adjusting the processing condition as described above, the position of the web forming table is adjusted accordingly to achieve the best uniformity of the resultant web. The as-formed web can then be subject to one of many conventional techniques for bonding or tangling to form the final spunbond fabric web, or wound up as it is without any further process, depending upon the end uses of the web.

The preferred embodiment includes the drawing unit which can be raised up to a close distance of about to 5 to 50 cm from the spinneret during normal production. Filaments of 0.1 to 2.5 deniers for polypropylene at a production rate of 70 to 360 kilograms per meter of machine width per hour and 0.3 to 4.5 deniers for polyethylene terephthalate at a production rate of 100 to 540 kilograms per meter of machine width per hour can be produced. The preferred embodiment further includes a web forming table which is capable of adjusting its position both horizontally and vertically in accordance with positions of the spinneret and the drawing unit to achieve a uniform non-woven web which may then be bonded by one of many known techniques to produce the final spunbond fabric webs.

Thus, it is apparent that the present invention has provided an apparatus and a process for producing spunbond non-woven webs that fully satisfies the objects, aims, and advantages set forth above.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A process for forming a spunbond, non-woven, polymeric fabric from a plurality of polymeric extruded filaments, comprising the steps of:

(a) at startup, extruding a plurality of vertically oriented filaments by melt-spinning through a spinneret from a thermoplastic polymer;

(b) at startup, threading the filaments through the slot with drawing means positioned at least 100 cm from said spinneret, using reduced throughput and nominal air pressure, 10 to 20 psig;

(c) increasing the air pressure and the throughput coordinately, while simultaneously reducing the distance between said spinneret and said drawing means until said distance between said spinneret and said drawing means is between 5 to 150 cm whereby the size of the filaments can be controlled by the distance between the drawing means and the spinneret;

(d) forming a web of a spunbound, non-woven polymeric fabric on a web-forming means positioned optimumly below said drawing means, whereby the size of the filaments can be controlled by the distance between the drawing means and the spinneret to form a uniform web with desired properties.

2. The process as in claim 1, wherein the adjusted distance after startup between the spinneret and the drawing means is between 5 cm and 150 cm.

3. The method as in claim 1, using polyethylene terephthalate reaching 8000 meters per minute of filaments spinning speed.

4. A process for forming a spunbond, non-woven, polymeric fabric from a plurality of polymeric extruded filaments, comprising the steps of:

(a) extruding a plurality of vertically oriented filaments by melt-spinning through a spinneret from a thermoplastic polymer forming a spunbound non-woven polymeric fabric;

(b) at startup, drawing said filaments by a drawing means positioned below said spinneret using nominal air pressure which applies a drawing force at a distance at least 100 cm away from said spinneret and a nominal throughput;

(c) increasing air pressure from a nominal air pressure to 55 psig, while simultaneously reducing the distance between said drawing means and said spinneret to less than 50 cm to greatly increase the throughput.

5. A process for forming a spunbond, non-woven, polymeric fabric from a plurality of polymeric extruded filaments for increasing the throughput, comprising the steps of:

(a) extruding a plurality of vertically oriented filaments from a thermoplastic polymer by melt-spinning through a spinneret;

(b) drawing said filaments by a drawing means positioned initially at least 100 cm from said spinneret, using air pressure of less than 20 psig;

(c) simultaneously changing and increasing the air pressure to the said drawing means, while correspondingly reducing the distance between said spinneret and said drawing means and increasing the throughput of said filaments until the throughput reaches a desired amount at predetermined values of simultaneous air pressure and spinneret and drawing means separation; and (d) forming a filament web of a spunbound non-woven polymeric fabric by depositing said extruded filaments on a web-forming means positioned below said drawing means.

6. A process as in claim 5, wherein the size of the filaments is selected by controlling the distance between the drawing means and the spinneret and the air pressure.

* * * * *